United States Patent [19]

Hamasaka

[11] Patent Number: 4,559,440

[45] Date of Patent: Dec. 17, 1985

[54] BOOT DRYING DEVICE

[76] Inventor: Kenneth B. Hamasaka, 1239 E. Maple Ave., Glendale, Calif. 91205

[21] Appl. No.: 614,514

[22] Filed: May 29, 1984

[51] Int. Cl.[4] ..... H05B 1/00

[52] U.S. Cl. ..... 219/215; 219/211; 219/523

[58] Field of Search ..... 219/215, 211, 523; 34/103, 104, 105; 12/129.4; 36/2.6

[56] References Cited

U.S. PATENT DOCUMENTS

| | | | |
|---|---|---|---|
| 1,701,973 | 2/1929 | Gehrs | 219/523 |
| 1,706,385 | 3/1929 | Graf | 219/211 |
| 2,025,950 | 12/1935 | Kurtz | 219/211 |
| 2,692,326 | 10/1954 | Crowell | 219/211 |
| 3,977,093 | 8/1976 | Santroch | 219/211 |

FOREIGN PATENT DOCUMENTS

| | | | |
|---|---|---|---|
| 44855 | 11/1931 | Denmark | 219/523 |
| 820944 | 11/1951 | Fed. Rep. of Germany | 219/211 |
| 936155 | 7/1948 | France | 219/211 |
| 1285346 | 1/1962 | France | 219/523 |
| 13351 | of 1914 | United Kingdom | 219/523 |
| 282222 | 1/1927 | United Kingdom | 219/523 |

*Primary Examiner*—C. L. Albritton
*Assistant Examiner*—Teresa J. Walberg
*Attorney, Agent, or Firm*—Roger A. Marrs

[57] ABSTRACT

Portable heating apparatus is disclosed herein for ready installation into a boot adjacent the inner liner next to the sole which includes cabling having branch leads at one end terminating in heat radiating electric bulbs and having an electrical source of power at the other end of the cable. Protective sleeves or cages surround the bulbs and single or double bulbs may be employed.

1 Claim, 6 Drawing Figures

BOOT DRYING DEVICE

BACKGROUND OF THE INVENTION

1. Field of the Invention

The present invention relates to the field of garment drying devices and, more particularly, to a novel drying device that may readily be inserted into a shoe or boot for effectively drying the boot without damaging the material of the shoe or boot.

2. Brief Description of the Prior Art

In the past, it has been the conventional practice to dry footwear by placing the footwear immediately adjacent to a radiating heat source such as a gas heater, steam heater or, in some instances, placing the footwear into an oven. Also, electrical heaters may be used whereby the footwear is placed adjacent to the heater so that the heat radiating therefrom for elevating room temperature may also be used for drying the footwear.

Problems and difficulties have been encountered when employing these conventional heating techniques and procedures which stem largely from the fact that excessive heat is used which rapidly dries the footwear and, in the case of leather material, the leather becomes stiff, hard and rigid. Sometimes, discoloration takes place where the leather turns to a chalky color. In other instances, when the footwear is composed of plastic such as for ski boots and the like, a fabric liner composed of polypropylene is placed inside the hard plastic shell and conventional heating methods do not promote heating transference through the hard plastic shell into a wet or damp liner. Therefore, drying does not effect and oftentimes the user must use the boots or footwear with wet or damp lining.

Therefore, a long standing need has existed to provide a novel footwear drying device or apparatus which is portable in use and which may be readily installed into the interior of a wet boot or shoe whereby heat radiating from the device will readily dry the lining or footwear itself.

Yet another object of the present invention is to provide a novel means for drying wet or damp boots which will not adversely affect the material of the boots or its lining.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF THE PREFERRED EMBODIMENT

Figure 1:
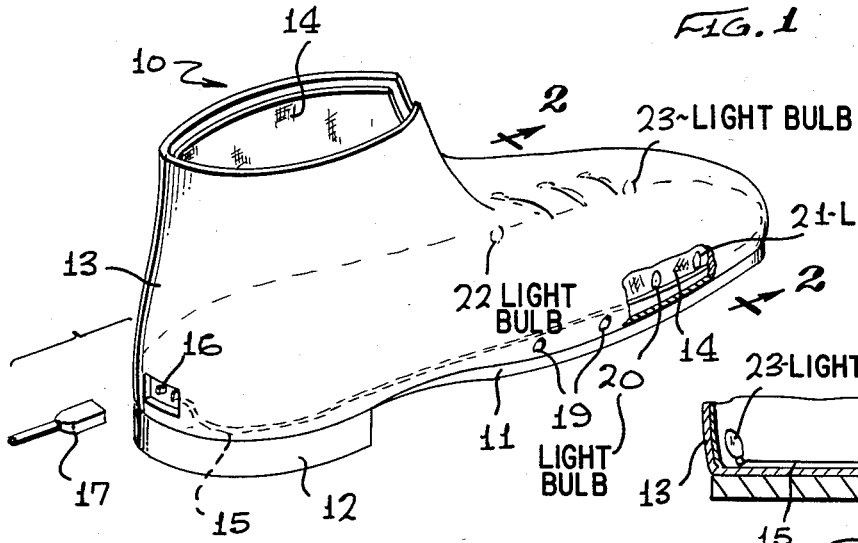
FIG. 1 is a perspective view of a typical boot employing the novel drying means of the present invention.

Referring to FIG. 1, a boot is shown in the general direction of arrow 10 which includes a sole 11 having a heel 12 and a shoe top 13. An opening is provided in the top of the shoe for insertion of the user's foot and it is to be noted that the interior of the boot is provided with a fabric liner 14 which is usually composed of polypropylene when the boot is constructed and used for skiing purposes. Generally, the top 13 is composed of a rigid material such as a hard plastic while the lining 14 is flexible, pliable and moisture absorbent. Also, it is to be understood that the boot 10 is typical and is not to limit the scope of the invention with respect to use or application. The present invention relates to means for drying the boot and/or its interior and liner and the footwear itself does not form a part of the present invention.

Referring further to FIG. 1, the drying means of the present invention includes an electrical circuit comprising a cable 15 which is coupled at one end to a two-pronged receptacle 16 intended to receive a power plug 17 which is connected to an AC line. The opposite end of the cable 15 is connected to a pair of light bulbs 20 and 21 which are projected into the lining 14 adjacent to the top of the boot. In other instances the light bulbs may be placed on the interior of the lining as well. However, it is to be understood that the placement of the bulb is not in any manner to interfere with the comfort or position of the user's foot within the boot. Preferably, a pair of bulbs 20 and 21 are connected along one side of the boot to the receptacle 16 while the other side of the boot also includes a cable from the receptacle leading to light bulbs 22 and 23 respectively.

Figure 2:
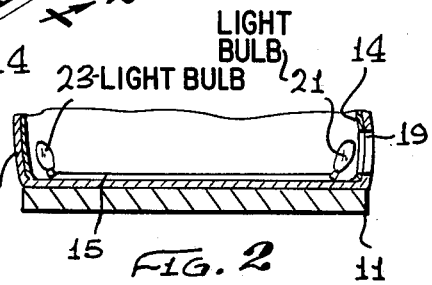
FIG. 2 is a transverse cross-sectional view of the boot shown in FIG. 1 as taken in the direction of arrows 2—2 thereof.

As noted in FIG. 2, the bulbs are on the interior of the shoe adjacent to the lining 14. However, it is to be understood that the boot 13 may also include apertures 19 through the sidewall thereof into which the bulbs are insertably placed during the drying procedure. In this latter version, the light bulbs and cabling are separate from the boot or shoe and are not intended to be carried therewith.

Figure 3:
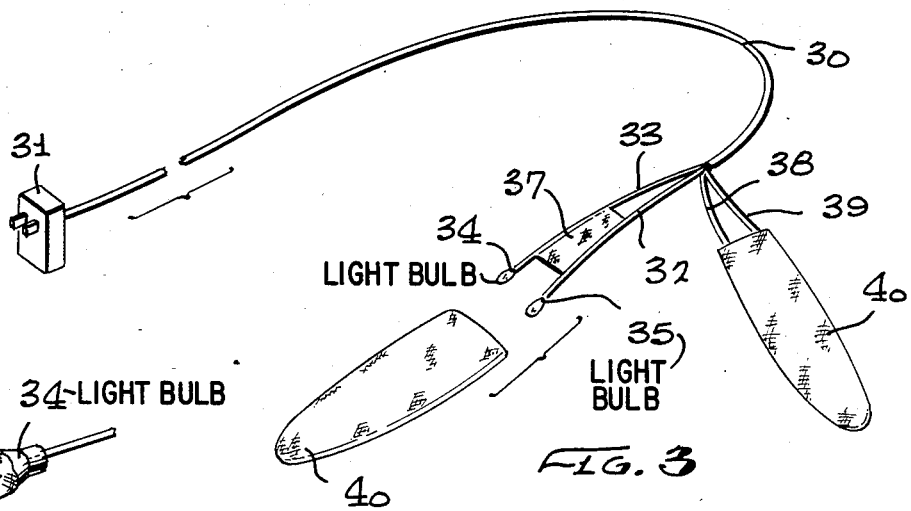
FIG. 3 is a perspective view of another embodiment of the present invention illustrating a portable drying means.
Figure 4:
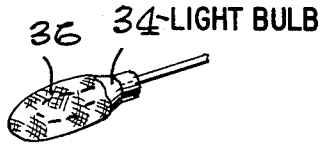
FIG. 4 is an enlarged perspective view of a cage or protector for individual light bulbs used in the portable device and dryer shown in FIG. 3.

Referring in detail to FIG. 3, another embodiment of the invention is shown which includes an elongated cable 30 having a plug 31 carried at one end terminating in prongs adapted to be inserted into the openings of a wall socket connected to a power source. Also, the opposite ends of the cable 30 extend into a pair of branches identified by leads 32, 33 and leads 38, 39. The extreme ends of the leads terminate in light bulbs such as represented by numerals 34 and 35 that are surrounded by a cage 36 for protection. Also, by employing the cage 36 as shown in FIG. 4, heat may readily radiate outward from the bulb 34 into the surrounding area and any moisture or dampness from the lining 14 cannot come into direct contact with the bulb or its cylinder.

Preferably, the cable 30 is terminated into a pair of branches so that one branch of light bulbs associated with cables 32, 33 may be placed into one shoe or boot while the other light bulbs associated with the leads 38, 39 may be placed into the other boot or shoe. In order to make handling easy, a holding strap or membrane 37 is employed for holding leads 32 and 33 together and a similar strap or membrane is employed for holding leads 38 and 39 together. If desired, an additional protective sleeve such as a knit or fabric cloth of wide mesh may be employed such as represented by the numeral 40.

Figure 5:
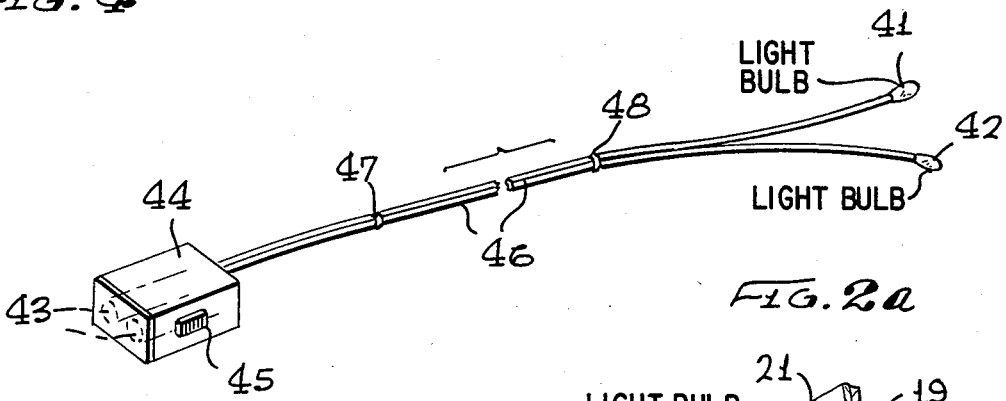
FIG. 5 is a perspective view of still another embodiment of the present invention illustrating a battery power source and a single pair of drying bulbs.
Figure 2A:
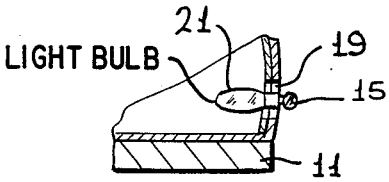

Referring now in detail to FIG. 5, a further embodiment of the invention is illustrated wherein the source of power for illuminating light bulbs 41 and 42 is derived from a battery source 43 within a container 44. Power is supplied when an actuator switch 45 is moved to the ON position and power is carried to the bulbs 41 and 42 via cabling 46. The cabling is held together by straps 47 and 48 and the leads extending from the cable 46 to the bulbs 41 and 42 are loose so that they may be divided for insertion into the left and right boots of a pair. In this embodiment, the voltage is extremely low and no protection for the bulbs 41 and 42 is required.

Therefore, it can be seen that an economical and inexpensive means is provided by drying the interior lining of ski boots or the like so that neither the sidewall, sole or lining of the boot is damaged. Furthermore, the apparatus may be build directly into the boot as shown in FIG. 1 or may be readily applied to the boot by insertion through apertures along the sides of the top 13. Other versions, such as those shown in FIGS. 3 and 5, permit the light bulb arrangements to be directly inserted through the opening in the top of the shoe or boot and the bulbs may be placed into position deep within the boot near the toe thereof. The source of power may either be line voltage which is reduced through an adapter such as the adapter 31 shown in FIG. 3 or may be battery powered as shown within the housing 44 connection with the embodiment shown in FIG. 5. Heat radiating outwardly from the bulbs of the apparatus will readily dry the lining or boot thereof.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a footwear drying device for simultaneously drying a pair of shoes comprising:

a common electric cable having at least two pairs of lead wires extending therethrough;

at least one light bulb operably coupled on an end of each of said pairs of leads;

mean including a power source connected to an opposite end of said cable from the ends coupled to said bulbs;

a cage carried on each of said leads disposed around each of said light bulbs in close proximity to said bulbs so as to allow insertion into and disposition within a toe area of each of said shoes in said pair;

said power source includes a battery and switch connected in series to said light bulbs via said cable;

each pair of said two pairs of lead wires are connected together by a separate strip disposing said bulbs of each pair in substantially fixed spaced apart relationship;

a fabric sleeve of wide mesh material removably covering each of said two pairs of light bulbs and leads; and each of said fabric material covered light bulb pairs adapted to be simultaneously insertable into said boots in spaced relationship.

* * * * *